United States Patent [19]

Owen

[11] Patent Number: 4,846,730

[45] Date of Patent: Jul. 11, 1989

[54] DAUGHTER BOARD STABILIZER FOR ROTARY CAM ZIF EDGE CARD CONNECTOR

[75] Inventor: Alex F. Owen, Spring Creek, Pa.

[73] Assignee: GTE Products Corporation, Stamford, Conn.

[21] Appl. No.: 91,418

[22] Filed: Sep. 3, 1987

[51] Int. Cl.[4] ..... H01R 13/62

[52] U.S. Cl. ..... 439/260; 439/267; 439/327

[58] Field of Search ..... 439/325–328, 439/260, 267

[56] References Cited

U.S. PATENT DOCUMENTS

| | | | |
|---|---|---|---|
| 3,188,598 | 6/1965 | Pferd | 439/260 |
| 3,982,807 | 9/1976 | Anhalt et al. | 439/260 |
| 4,487,468 | 12/1984 | Fedder et al. | 439/325 |
| 4,553,803 | 11/1985 | Lapraik et al. | 439/267 |
| 4,553,804 | 11/1985 | Lapraik et al. | 439/267 |
| 4,695,111 | 9/1987 | Grabbe et al. | 439/325 |

*Primary Examiner*—Joseph H. McGlynn

*Attorney, Agent, or Firm*—William H. McNeill

[57] ABSTRACT

A ZIF connector includes cam operated locking means which engage and position an inserted PCB card before the contacts engage the board.

4 Claims, 3 Drawing Sheets

DAUGHTER BOARD STABILIZER FOR ROTARY CAM ZIF EDGE CARD CONNECTOR

TECHNICAL FIELD

This invention relates to printed circuit board (PCB) card connectors and more particularly to such connectors which include means to lock a card in place.

BACKGROUND ART

Zero insertion force (ZIF) connectors have achieved credibility in the art. However, it would be an advance in this art to provide a connector which will positively locate and hold an inserted card prior to the engagement of the contacts.

DISCLOSURE OF THE INVENTION

It is, therefore, an object of this invention to obviate the disadvantages of the prior art.

It is another object to enhance ZIF connectors.

These objects are accomplished, in one aspect of the invention, by the provision of a PCB card connector which includes card locking means. The last named means is positioned in a pocket formed in the connector body and is cam actuated. The locking means comprises a resilient element having a first end formed to engage a PCB card and a second end formed to provide a spring force. A center section provides the cam surface to act with a rotatable cam.

The mechanism is inexpensive to fabricate, easy to assemble and easy to use.

BRIEF DESCRIPTION OF THE DRAWINGS

FIG. 4 is a view similar to FIG. 2 after full actuation of the locking device.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
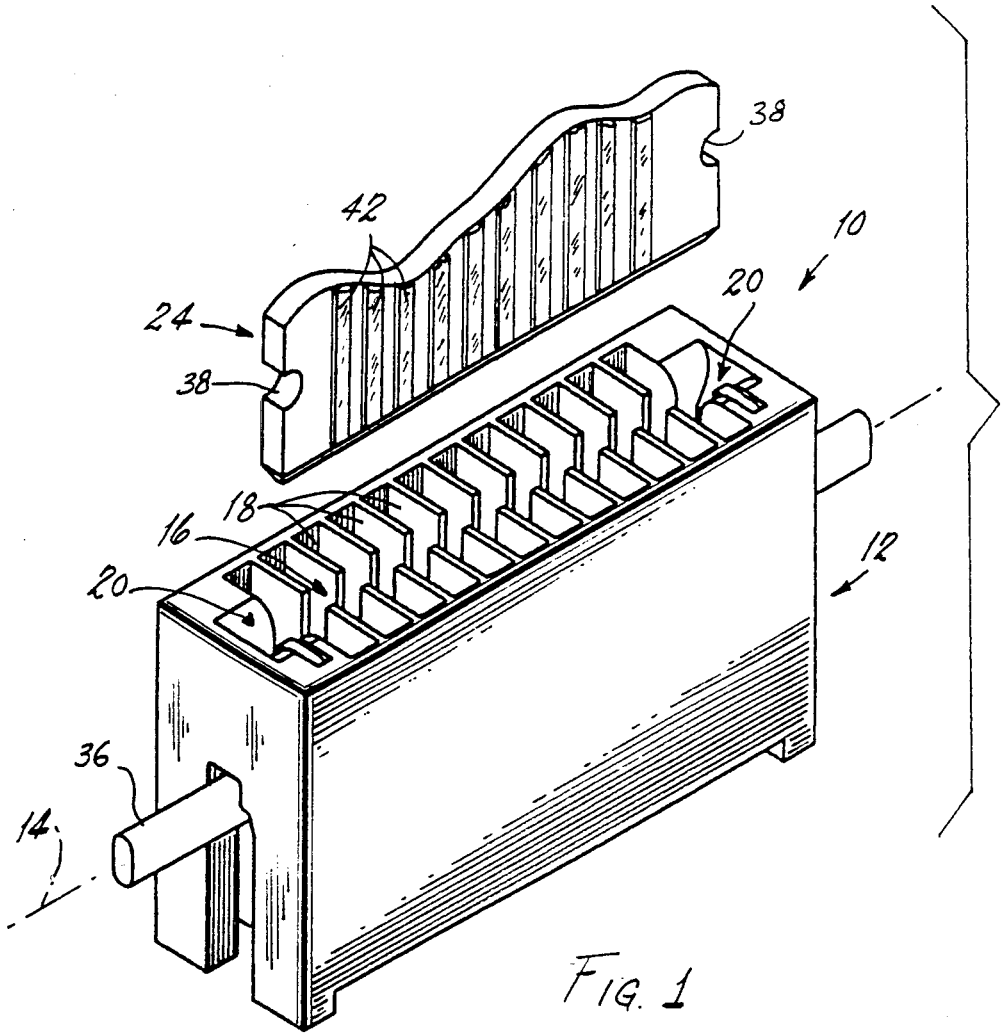
FIG. 1 is an exploded, perspective view of a connector and PCB card.

Referring now to the drawings with greater particularity, there is shown in FIG. 1 a PCB card connector 10, which can be a ZIF connector of the type shown in U.S. Pat. No. 4,553,803 or 4,553,804.

Connector 10 has an elongated body 12 having a longitudinal axis 14 and having a card receiving groove 16 formed therein. The groove 16 is aligned with axis 14.

A plurality of electrical contact holding compartments 18 are spaced along groove 16, transverse thereto. At least one, and preferably two, pockets 20 are formed in body 12, adjacent the ends thereof.

Locking means 22 (FIGS. 2 and 3) for positioning a PCB card 24 are provided in the pockets. The locking means 22 comprise a resilient element 26 having a center portion 28 containing a cam surface 30, a first end 32 for engaging the card 24 and a second end 34 formed to provide a substantially "U" shaped, resilient tail.

The resilient element 26 can be stamped from a sheet of 0.035" thick 688 alloy, also known as miscellaneous bronze. This material is delineated in ASTM Specification No. B-592 and is available from Olin Brass Co.

A rotatable cam 36 projects through body 12, along axis 14, and penetrates the center portions 28 and engages cam surfaces 30.

Figure 2:
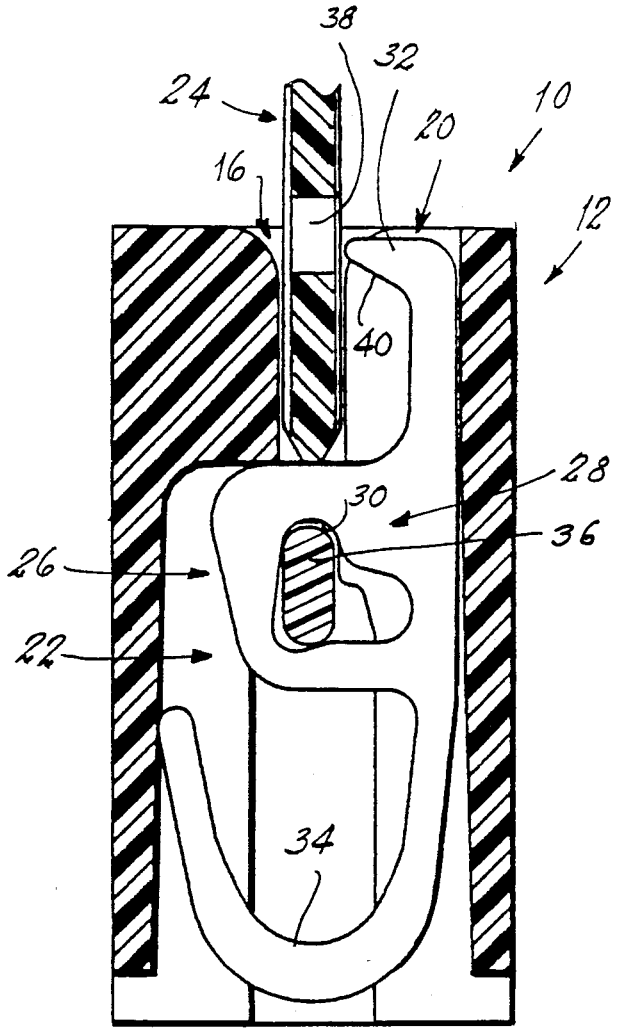
FIG. 2 is an elevational sectional view of an embodiment of the invention prior to actuation.
Figure 3:
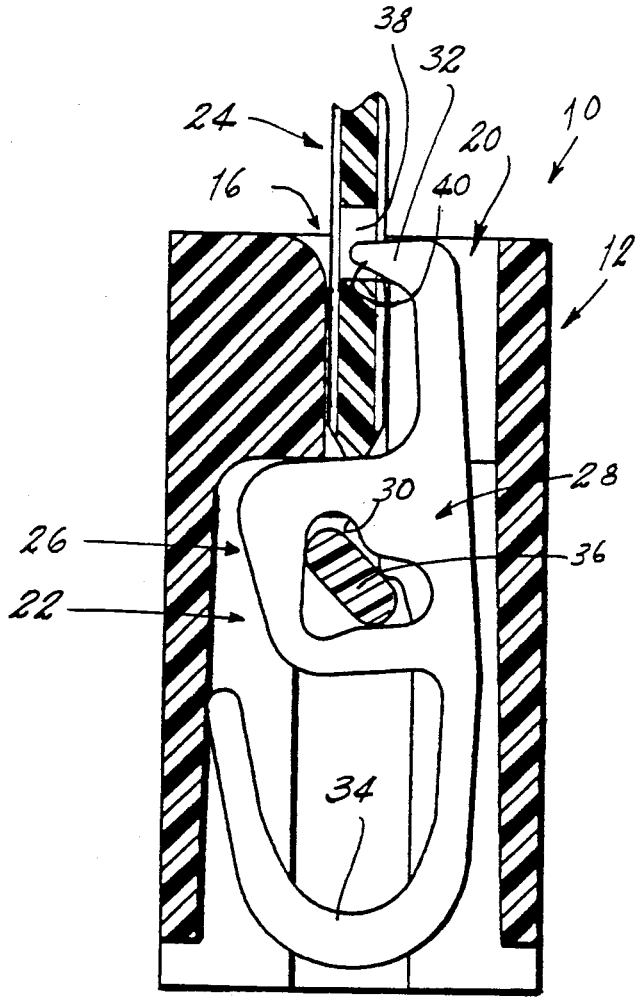
FIG. 3 is a view similar to FIG. 2 after a first phase of actuation of a locking device.

As can be seen from FIG. 2, with can 36 in a vertical position, the resilient element 26, and first end 32, are in an "open" position and card 24 can be easily inserted. Upon rotation of cam 36, in this instance, a counterclockwise direction, first end 32 engages notch 38 in card 24 and secures card 24 in position. First end 32 is further provided with a cam surface 40 which forces card 24 downward into groove 16. When the locking means 22 are employed with a ZIF connector, it is preferable that the cam surfaces be so arranged that first end 32 engages notch 38 and positions card 24 before the cam engages the electrical contacts (not shown) against the conductors 42 carried by card 24.

A reverse rotation of the cam releases the locking device and moves it out of the way to prevent it from hindering the removal of the P.C. board.

The cam surface 40 formed on first end 32 provides an additional benefit in that it will allow inadvertent withdrawal of card 24 even if the locking means 22 has not been released.

The resilient nature of the locking means 22 allows for the device to be attempted to be locked onto a board that does not have a notch 38 without damaging the board, the locking means or the connector. Further, the resilient nature of the lock automatically compensates for any variability which may be present in the assembled components.

Accordingly, there is here provided a PCB card locking and positioning means which is readily adaptable to PCB card connectors in general and ZIF's in particular.

While there have been shown and described what are at present considered to be the preferred embodiments of the invention, it will be apparent to those skilled in the art that various changes and modifications can be made herein without departing from the scope of the invention as defined by the appended claims.

I claim:

1. A printed circuit card connector comprising:

an elongated body having a longitudinal axis and having an elongated printed circuit card receiving groove formed therein and aligned with said longitudinal axis;

a plurality of electrical contact holding compartments spaced along said groove, transverse thereto;

a pocket formed in said body;

locking means for said card positioned in said pocket, said locking means comprising a resilient element having a center portion formed to provide a cam surface, a first end formed to provide card engaging means and a second end formed to provide a substantially "U" shaped, resilient tail; and a rotatable cam extending through said center portion and engaging said cam surface.

2. The card connector of claim 1 wherein said first end is formed to engage a notch in said card.

3. The card connector of claim 2 wherein said first end has a cam surface, whereby said card can be removed from said connector without disengaging said locking means.

4. The card connector of claim 1 wherein said pocket is formed on an end of said body, adjacent one of said plurality of holding compartments.

* * * * *

UNITED STATES PATENT AND TRADEMARK OFFICE

CERTIFICATE OF CORRECTION

PATENT NO. : 4,846,730

DATED : 7/11/89

INVENTOR(S) : Alex F. Owen

It is certified that error appears in the above-identified patent and that said Letters Patent is hereby corrected as shown below:

In the drawings, Fig. 4 should be added as shown on the attached page.

Signed and Sealed this

Thirtieth Day of April, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,846,730

DATED : 7/11/89

INVENTOR(S) : Alex F. Owen

It is certified that error appears in the above-identified patent and that said Letters Patent is hereby corrected as shown below:

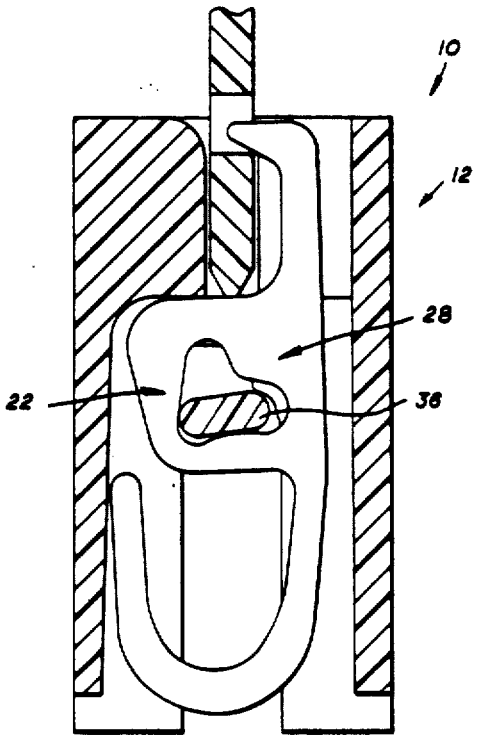

FIG. 4